US006224357B1

(12) United States Patent
Komai et al.

(10) Patent No.: US 6,224,357 B1
(45) Date of Patent: May 1, 2001

(54) SCROLL FLUID MACHINE HAVING AN ORBITING RADIUS VARYING MECHANISM AND A CLEARANCE BETWEEN THE WRAP PORTIONS

(75) Inventors: Yuji Komai; Toshikazu Harashima, both of Tokyo; Kazutaka Suefuji, Kanagawa-ken, all of (JP)

(73) Assignee: Tokioco Ltd., Kanagawa-ken (JP)

( * ) Notice: Subject to any disclaimer, the term of this patent is extended or adjusted under 35 U.S.C. 154(b) by 0 days.

(21) Appl. No.: 09/401,629

(22) Filed: Sep. 22, 1999

(30) Foreign Application Priority Data

Sep. 29, 1998 (JP) ..... 10-291461

(51) Int. Cl.[7] ..... F01C 1/04; F01C 17/06
(52) U.S. Cl. ..... 418/55.2; 418/55.5
(58) Field of Search ..... 418/55.2, 55.5, 418/57

(56) References Cited

U.S. PATENT DOCUMENTS 4,551,078 * 11/1985 Hiraga ..... 418/57
5,342,184 * 8/1994 Comparin et al. ..... 418/55.2

FOREIGN PATENT DOCUMENTS 59-12187 * 1/1984 (JP) ..... 418/55.2
9-144674 * 3/1997 (JP) ..... 418/55.5

* cited by examiner

*Primary Examiner*—John J. Vrablik
(74) *Attorney, Agent, or Firm*—Wenderoth, Lind & Ponack L.L.P.

(57) ABSTRACT

A fixed scroll member has a spiral wrap portion. An orbiting scroll member has a spiral wrap portion similar to the wrap portion of the fixed scroll member. The wrap portion of the orbiting scroll member has its wall thickness increased at the inner peripheral surface side thereof to have a larger wall thickness than that of the wrap portion of the fixed scroll member. The inner peripheral surface of the wrap portion of the orbiting scroll member contacts the outer peripheral surface of the wrap portion of the fixed scroll member at two contact points. On the other hand, a clearance is formed between the outer peripheral surface of the wrap portion of the orbiting scroll member and the inner peripheral surface of the wrap portion of the fixed scroll member over the entire length of the peripheral surfaces. The orbiting scroll member is constantly urged in a direction in which rotational torque acts, and thus allowed to orbit smoothly.

12 Claims, 10 Drawing Sheets

SCROLL FLUID MACHINE HAVING AN ORBITING RADIUS VARYING MECHANISM AND A CLEARANCE BETWEEN THE WRAP PORTIONS

BACKGROUND OF THE INVENTION

The present invention relates to a scroll fluid machine suitable for use in an air compressor, a vacuum pump, etc. by way of example. More particularly, the present invention relates to a scroll fluid machine provided with a variable crank for varying the orbiting radius of an orbiting scroll member.

In general, a scroll fluid machine has a casing and a fixed scroll member provided in the casing and having a spiral wrap portion standing on an end plate. A driving shaft is rotatably provided in the casing. An orbiting scroll member is orbitably provided on the distal end of the driving shaft. The orbiting scroll member has a spiral wrap portion standing on an end plate. The wrap portion overlaps the wrap portion of the fixed scroll member to define a plurality of compression chambers.

These days, there is known a scroll fluid machine in which a fitting portion is provided at the distal end of the driving shaft, while a boss portion is provided on the orbiting scroll member, and an orbiting radius varying mechanism is provided between the fitting portion of the driving shaft and the boss portion of the orbiting scroll member. The orbiting radius varying mechanism is fitted to the fitting portion and the boss portion to vary the orbiting radius of the orbiting scroll member [for example, see Japanese Patent Application Unexamined Publication (KOKAI) No. 09-144674 (1997)].

In the scroll fluid machine using such an orbiting radius varying mechanism, the wrap portion of the orbiting scroll member and the wrap portion of the fixed scroll member are always in contact with each other at a plurality of points. Assuming that the two wrap portions contact each other at the inner peripheral surface of the wrap portion of the orbiting scroll member on one side of the center of orbiting motion of the orbiting scroll member along one diameter, the two wrap portions contact each other at the outer peripheral surface of the wrap portion of the orbiting scroll member on the other side of the center along the same diameter. Accordingly, when moving in one direction, the orbiting scroll member is subjected to frictional forces in the opposite direction to the direction of movement at a plurality of contact points. At this time, the frictional forces occurring on one side of the center of the orbiting scroll member and those occurring on the other side of the center act on the orbiting scroll member so as to urge it to rotate in opposite directions to each other.

The orbiting scroll member is prevented from rotating. In actuality, however, there is backlash between the orbiting scroll member and the rotation preventing mechanism. Therefore, when the tendency of the orbiting scroll member-orbiting mechanism to urge the orbiting scroll member to rotate is overcome by the tendency of the total sum of the above frictional forces to urge the orbiting scroll member to rotate in the opposite direction, the orbiting scroll member rotates slightly in the opposite direction. Accordingly, the structure of the prior art causes vibration and noise unfavorably.

In view of the above-described problems with the prior art, an object of the present invention is to provide a scroll fluid machine in which the orbiting scroll member is constantly urged in a direction in which rotational torque acts and so it is allowed to orbit smoothly.

BRIEF SUMMARY OF THE INVENTION

The present invention is applicable to a scroll fluid machine including a casing and a fixed scroll member provided in the casing. The fixed scroll member has a spiral wrap portion standing on an end plate. A driving shaft is rotatably provided in the casing. The driving shaft has a fitting portion at the distal end thereof. An orbiting scroll member is orbitably provided on the distal end of the driving shaft. The orbiting scroll member has a spiral wrap portion standing on the front side of an end plate. The wrap portion overlaps the wrap portion of the fixed scroll member to define a plurality of compression chambers. The orbiting scroll member further has a boss portion provided on the rear side of the end plate. A variable crank is fitted to the fitting portion of the driving shaft and the boss portion of the orbiting scroll member to vary the orbiting radius of the orbiting scroll member.

An arrangement adopted by the present invention is characterized in that the inner peripheral surface of the wrap portion of the orbiting scroll member and the outer peripheral surface of the wrap portion of the fixed scroll member contact each other at at least some region in the circumferential direction thereof, and a clearance is formed between the outer peripheral surface of the wrap portion of the orbiting scroll member and the inner peripheral surface of the wrap portion of the fixed scroll member over the entire periphery.

In the present invention, the wrap portion of the orbiting scroll member may be formed with a larger wall thickness than that of the wrap portion of the fixed scroll member by increasing the wall thickness of the wrap portion of the orbiting scroll member at the inner peripheral surface side thereof.

With the above-described arrangement, the inner peripheral surface of the wrap portion of the orbiting scroll member, which is formed with an increased wall thickness, contacts the outer peripheral surface of the wrap portion of the fixed scroll member at some region in the circumferential direction thereof. At this time, because the wrap portion of the orbiting scroll member has its wall thickness increased at the inner peripheral surface side thereof, the outer peripheral surface of the wrap portion of the orbiting scroll member and the inner peripheral surface of the wrap portion of the fixed scroll member can be separated from each other over the entire periphery. Therefore, a clearance can be formed between the outer peripheral surface of the wrap portion of the orbiting scroll member and the inner peripheral surface of the wrap portion of the fixed scroll member over the entire length of the peripheral surfaces of the wrap portion.

In the present invention, the wrap portion of the fixed scroll member may be formed with a smaller wall thickness than that of the wrap portion of the orbiting scroll member by reducing the wall thickness of the wrap portion of the fixed scroll member at the inner peripheral surface side thereof.

With the above-described arrangement, the inner peripheral surface of the wrap portion of the orbiting scroll member contacts the outer peripheral surface of the wrap portion of the fixed scroll member at some region in the circumferential direction thereof. At this time, because the wrap portion of the fixed scroll member has its wall thickness reduced at the inner peripheral surface side thereof, a clearance can be formed between the inner peripheral surface of the wrap portion of the fixed scroll member, which is formed with a reduced wall thickness, and the outer peripheral surface of the wrap portion of the orbiting scroll member over the entire length of the peripheral surfaces.

In the present invention, the wrap portion of the orbiting scroll member may be formed with a smaller wall thickness than that of the wrap portion of the fixed scroll member by reducing the wall thickness of the wrap portion of the orbiting scroll member at the outer peripheral surface side thereof.

With the above-described arrangement, the inner peripheral surface of the wrap portion of the orbiting scroll member contacts the outer peripheral surface of the wrap portion of the fixed scroll member at some region in the circumferential direction thereof. At this time, because the wrap portion of the orbiting scroll member has its wall thickness reduced at the outer peripheral surface side thereof, a clearance can be formed between the inner peripheral surface of the wrap portion of the fixed scroll member and the outer peripheral surface of the wrap portion of the orbiting scroll member, which is formed with a reduced wall thickness, over the entire length of the peripheral surfaces.

In the present invention, the wrap portion of the fixed scroll member may be formed with a larger wall thickness than that of the wrap portion of the orbiting scroll member by increasing the wall thickness of the wrap portion of the fixed scroll member at the outer peripheral surface side thereof.

With the above-described arrangement, the inner peripheral surface of the wrap portion of the orbiting scroll member contacts the outer peripheral surface of the wrap portion of the fixed scroll member, which is formed with an increased wall thickness, at some region in the circumferential direction thereof. At this time, because the wrap portion of the fixed scroll member has its wall thickness increased at the outer peripheral surface side thereof, the outer peripheral surface of the wrap portion of the orbiting scroll member and the inner peripheral surface of the wrap portion of the fixed scroll member can be separated from each other over the entire length of the peripheral surfaces. Accordingly, a clearance can be formed between the outer peripheral surface of the wrap portion of the orbiting scroll member and the inner peripheral surface of the wrap portion of the fixed scroll member over the entire length of the peripheral surfaces.

In the present invention, either one of the wrap portion of the orbiting scroll member and the wrap portion of the fixed scroll member may be provided out of phase with respect to the other wrap portion by a small angle in the circumferential direction.

With the above-described arrangement, the wrap portion of the orbiting scroll member and the wrap portion of the fixed scroll member can be slightly phase-shifted from each other. Therefore, the inner peripheral surface of the wrap portion of the orbiting scroll member and the outer peripheral surface of the wrap portion of the fixed scroll member can be brought into contact with each other at some region in the circumferential direction, and a clearance can be formed between the outer peripheral surface of the wrap portion of the orbiting scroll member and the inner peripheral surface of the wrap portion of the fixed scroll member.

In the present invention, the wrap portion of the orbiting scroll member may be formed with a wall thickness approximately equal to the wall thickness of the wrap portion of the fixed scroll member by increasing the wall thickness of the wrap portion of the orbiting scroll member at the inner peripheral surface side thereof and reducing the wall thickness at the outer peripheral surface side thereof.

With the above-described arrangement, the inner peripheral surface of the wrap portion of the orbiting scroll member, at which the wrap portion has its wall thickness increased, contacts the outer peripheral surface of the wrap portion of the fixed scroll member at some region in the circumferential direction thereof. At this time, because the wrap portion of the orbiting scroll member has its wall thickness reduced at the outer peripheral surface side thereof, the outer peripheral surface of the wrap portion of the orbiting scroll member and the inner peripheral surface of the wrap portion of the fixed scroll member can be separated from each other over the entire length of the peripheral surfaces.

In the present invention, the wrap portion of the fixed scroll member may be formed with a wall thickness approximately equal to the wall thickness of the wrap portion of the orbiting scroll member by reducing the wall thickness of the wrap portion of the fixed scroll member at the inner peripheral surface side thereof and increasing the wall thickness at the outer peripheral surface side thereof.

With the above-described arrangement, the inner peripheral surface of the wrap portion of the orbiting scroll member contacts the outer peripheral surface of the wrap portion of the fixed scroll member at some region in the circumferential direction thereof. At this time, because the wrap portion of the fixed scroll member has its wall thickness reduced at the inner peripheral surface side thereof and increased at the outer peripheral surface side thereof, a clearance can be formed between the inner peripheral surface of the wrap portion of the fixed scroll member and the outer peripheral surface of the wrap portion of the orbiting scroll member over the entire length of the peripheral surfaces.

DETAILED DESCRIPTION OF THE INVENTION

Figure 1:
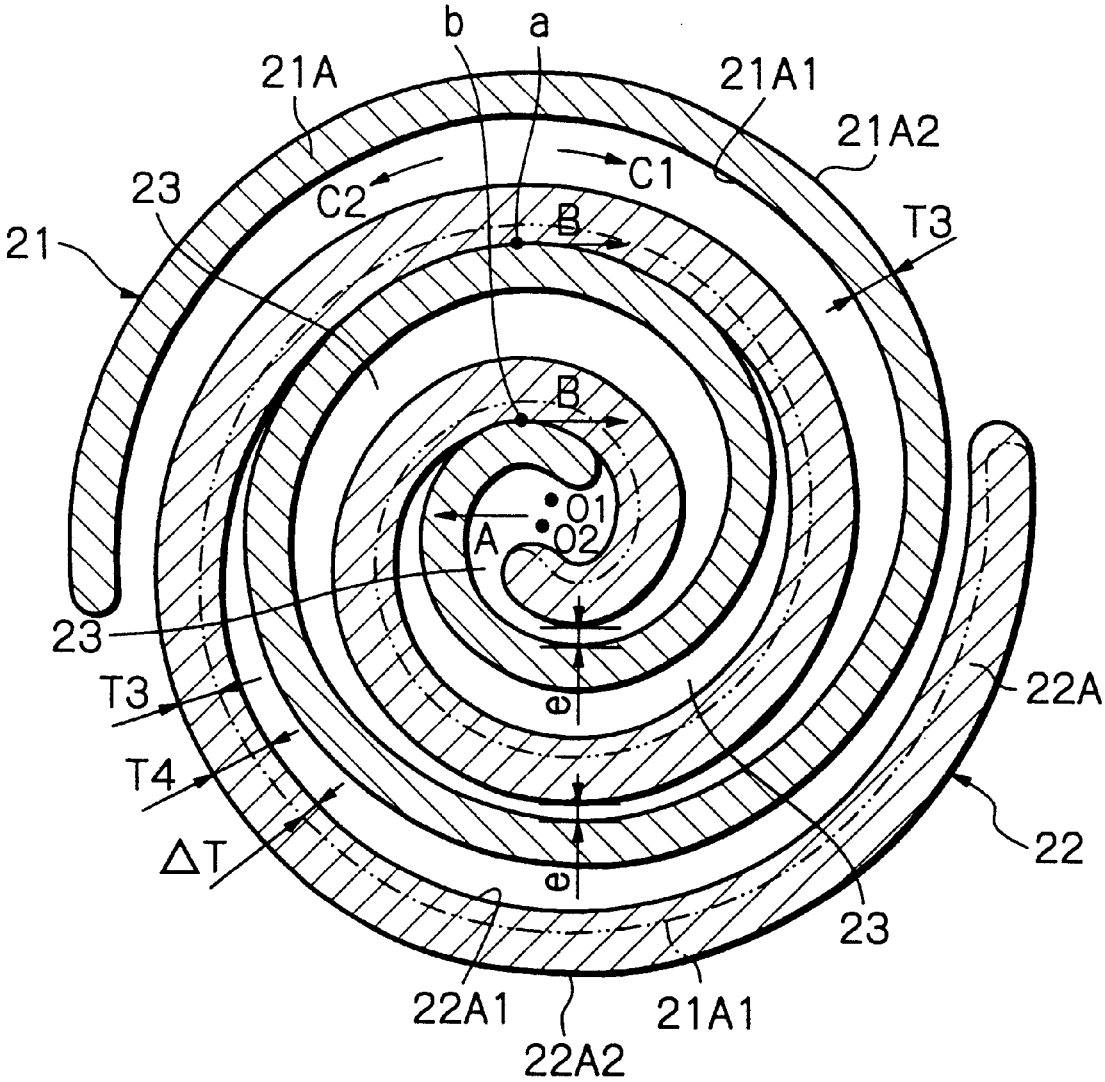
FIG. 1 is a transverse sectional view showing a wrap portion of an orbiting scroll member and a wrap portion of a fixed scroll member according to a first embodiment of the present invention.

Prior to the description of embodiments of the present invention, an oilless scroll air compressor will be described with reference to FIGS. 8 to 9 as an example of the scroll fluid machine according to the prior art for the purpose of facilitating the understanding of the present invention.

A casing 1 forms an outer frame of a scroll air compressor. The casing 1 has a bearing portion 1A formed in the shape of a stepped cylinder having a relatively small diameter. A disk-shaped cover portion 1B extends radially outward from the proximal end of the bearing portion 1A. A large-diameter portion 1C projects axially from the outer periphery of the cover portion 1B. The large-diameter portion 1C is provided with a flange portion 1D projecting radially outward.

A fixed scroll member 2 is secured to the distal end of the casing 1. The fixed scroll member 2 is made of a rigid material, e.g. an aluminum-base material, or an iron-base material. The fixed scroll member 2 has an end plate 2A formed approximately in the shape of a disk. The end plate 2A is positioned so that the center thereof is coincident with an axis O1-O1 of a driving shaft 3 (described later). A cylindrical portion 2B extends axially from the outer edge of the end plate 2A toward the casing 1. A flange portion 2C projects radially outward from the outer periphery of the cylindrical portion 2B and abuts on the flange portion 1D of the casing 1. A spiral wrap portion 2D is provided on the front side of the end plate 2A to extend axially. A large number of radiating plates 2E are provided in parallel on the rear side of the end plate 2A.

The wrap portion 2D of the fixed scroll member 2 has a uniform thickness T1 over substantially the entire periphery. The wrap portion 2D of the fixed scroll member 2 has an inner peripheral surface 2D1 on the side thereof closer to the axis O1-O1, and an outer peripheral surface 2D2 on the radially outer side of the wrap portion 2D. The inner peripheral surface 2D1 and the outer peripheral surface 2D2 extend circumferentially.

The driving shaft 3 is located in the bearing portion 1A of the casing 1 and supported to be rotatable about the axis O1-O1, which forms the center of orbiting motion. The driving shaft 3 is coupled at the proximal end thereof to an electric motor (not shown) or the like. The distal end portion of the driving shaft 3 extends into the bearing portion 1A of the casing 1. The driving shaft 3 has a fitting hole 3A provided at the distal end thereof as a fitting portion in which a fitting shaft portion 5A of a variable crank 5 (described later) is fitted.

An orbiting plate 4 is provided in the large-diameter portion 1C of the casing 1 to constitute a part of an orbiting scroll member 7 (described later). The orbiting plate 4 is provided with a boss portion 4A projecting from the center of the rear side thereof.

A variable crank 5 is provided between the distal end of the driving shaft 3 and the boss portion 4A of the orbiting plate 4 to form an orbiting radius varying mechanism. The variable crank 5 has a fitting shaft portion 5A rotatably fitted in the fitting hole 3A of the driving shaft 3, and an eccentric shaft portion 5B rotatably fitted in the boss portion 4A of the orbiting plate 4. The eccentric shaft portion 5B is provided at a position where the axis O2-O2 thereof is eccentric with respect to the axis O1-O1 of the driving shaft 3 by a dimension δ. During the operation of the scroll air compressor, the variable crank 5 rotates together with the driving shaft 3 as one unit, thereby causing the orbiting scroll member 7 to perform an orbiting motion with an orbiting radius δ, together with the orbiting plate 4.

Figure 8:
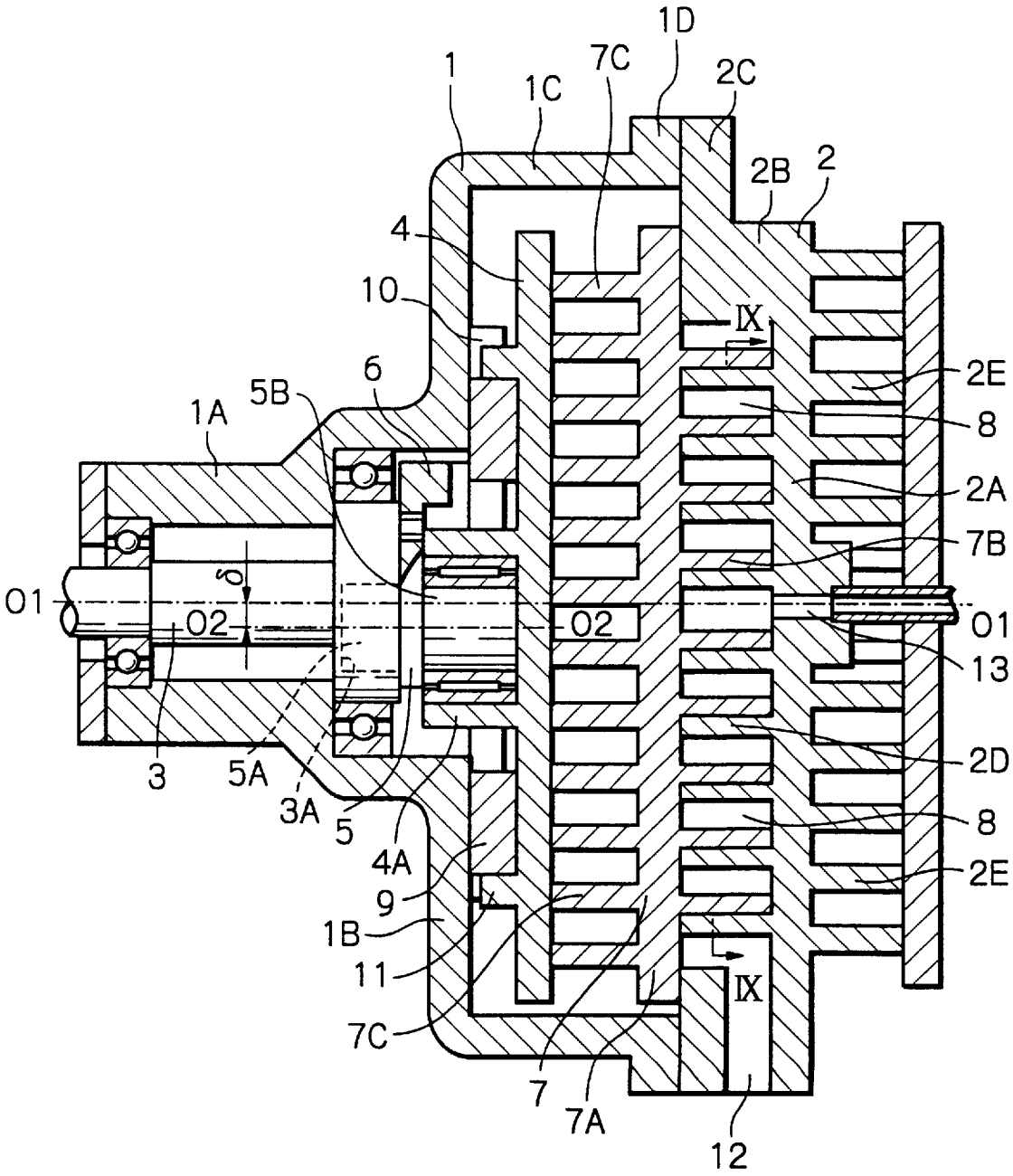
Fig. 8 PRIOR ART
FIG. 8 is a longitudinal sectional view showing a scroll air compressor according to the prior art.
Figure 8A:
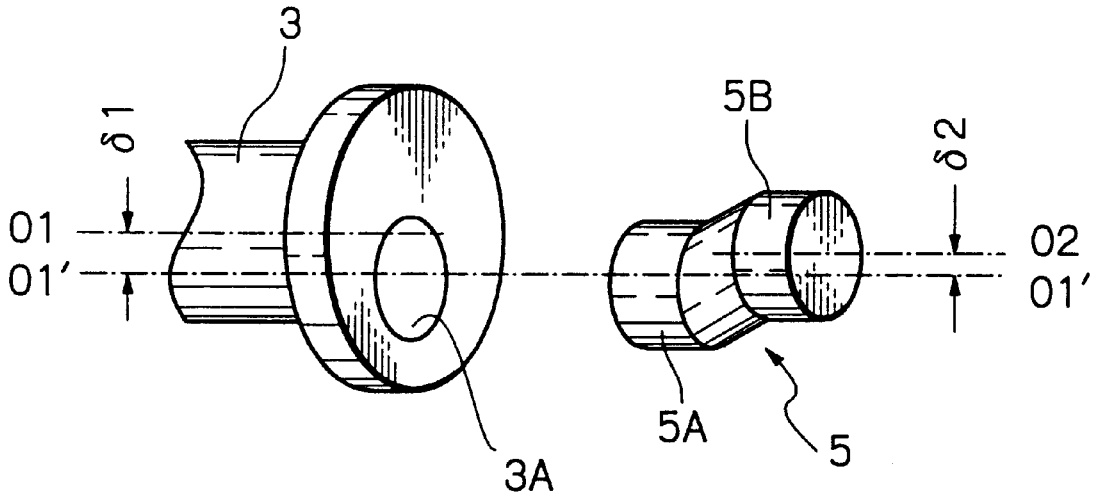
Fig. 8A PRIOR ART
FIG. 8A is an exploded perspective view showing the relationship between a variable crank and a driving shaft in FIG. 8.

FIG. 8A shows the variable crank 5 in more detail. In this figure, illustration of a balance weight 6 (described later) is omitted for the convenience of explanation. The fitting hole 3A formed in the driving shaft 3 is so set that the center O1' of the fitting hole 3A is eccentric with respect to the axial center O1 of the driving shaft 3 by δ1. The fitting shaft portion 5A is rotatably received in the fitting hole 3A. The eccentric shaft portion 5B is eccentric with respect to the fitting shaft portion 5A by δ2. As the driving shaft 3 rotates, the variable crank 5 rotates centrifugally about the fitting hole 3A as far as a position where the wrap portion 7B of the orbiting scroll member 7 contacts the wrap portion 2D of the fixed scroll member 2. As a result, the amount of eccentricity between the axial center O1 of the driving shaft 3 and the axial center O2 of the eccentric shaft portion 5B becomes δ.

In addition, the variable crank 5 receives the resultant force from the pressure in compression chambers 8 (described later) and the centrifugal force produced by the rotation of the driving shaft 3. Consequently, while rotating relative to the driving shaft 3, the variable crank 5 presses the wrap portion 7B of the orbiting scroll member 7 toward the wrap portion 2D of the fixed scroll member 2.

Furthermore, the variable crank 5 is integrally provided with a balance weight 6 (FIG. 8). The balance weight 6 is adapted to obtain a rotational balance of the whole driving shaft 3, including the variable crank 5, with respect to the orbiting motion of the orbiting scroll member 7. More particularly, in the absence of the balance weight, the centrifugal force generated by the variable crank 5 may press the wrap portion 7B of the orbiting scroll member to the wrap portion 2D of the fixed scroll member too strongly. One of the functions of the balance weight is to relieve this centrifugal force.

The orbiting scroll member 7 is orbitably provided in the casing 1 opposite to the fixed scroll member 2. The orbiting scroll member 7 is made of a rigid material, e.g. an aluminum-base material, or an iron-base material. The orbiting scroll member 7 has an end plate 7A formed in the shape of a disk. A spiral wrap portion 7B is provided on the front side of the end plate 7A to extend axially. A large number of radiating plates 7C are provided in parallel on the rear side of the end plate 7A. The orbiting scroll member 7 is integrally secured to the orbiting plate 4 through the radiating plates 7C and thus performs an orbiting motion, together with the orbiting plate 4.

The wrap portion 7B of the orbiting scroll member 7 has a uniform thickness T2 over substantially the entire length of the peripheral surfaces. The thickness T2 is set at approximately the same value as the thickness T1 of the wrap portion 2D of the fixed scroll member 2. The orbiting scroll member 7 is positioned so that the wrap portion 7B overlaps the wrap portion 2D of the fixed scroll member 2 with a predetermined offset angle (e.g. 180 degrees) in the rotational direction. Thus, a plurality of compression chambers 8 are defined between the two wrap portions 7B and 2D. The wrap portion 7B of the orbiting scroll member 7 has an inner peripheral surface 7B1 located on the side thereof closer to the axis O1-O1, and an outer peripheral surface 7B2 located on the radially outer side of the wrap portion 7B. The inner peripheral surface 7B1 and the outer peripheral surface 7B2 extend circumferentially in a spiraling manner.

The wrap portion 7B of the orbiting scroll member 7 has surface coating layers (not shown) formed on both the inner and outer peripheral surfaces 7B1 and 7B2. The surface coating layers are formed by coating both the inner and outer peripheral surfaces 7B1 and 7B2 with a non-rigid material, for example, a molybdenum disulfide, fluorine resin or phosphoric acid film. The inner and outer peripheral surfaces 2D1 and 2D2 of the wrap portion 2D of the fixed scroll member 2 are also provided with surface coating layers (not shown) of a similar non-rigid material. These surface coating layers reduce the frictional resistance between the wrap portion 2D of the fixed scroll member 2 and the wrap portion 7B of the orbiting scroll member 7 and also enhance the airtightness between the wrap portions 2D and 7B.

A movable plate 9 forms a rotation preventing mechanism for preventing rotation of the orbiting scroll member 7. The movable plate 9 is guided so as to be slidable in two orthogonal axis directions between a guide 10 provided on the casing 1 and a guide 11 provided on the orbiting plate 4. Thus, the movable plate 9 prevents rotation of the orbiting scroll member 7 while allowing the orbiting scroll member 7 to perform a circular motion (orbiting motion) with an orbiting radius δ. Thus, the movable plate 9 constitutes an Oldham's coupling.

The scroll air compressor according to the prior art, which has the above-described arrangement, operates as follows.

First, when the driving shaft 3 is rotated with an electric motor, the orbiting scroll member 7 performs an orbiting motion with an orbiting radius δ about the driving shaft 3. Consequently, the compression chambers 8, which are defined between the wrap portion 2D of the fixed scroll member 2 and the wrap portion 7B of the orbiting scroll member 7, are continuously contracted. Thus, air is sucked into the compression chambers 8 from a suction opening 12 provided on the outer periphery of the fixed scroll member 2. The sucked air is successively compressed in the compression chambers 8 during the orbiting motion of the orbiting scroll member 7. Finally, the compressed air is supplied from the central compression chamber 8 to an external air tank (not shown) through a discharge opening 13 provided in the center of the fixed scroll member 2.

During the operation, the variable crank 5 adjusts the orbiting radius of the orbiting scroll member 7 so as to press the wrap portion 7B of the orbiting scroll member 7 against the wrap portion 2D of the fixed scroll member 2, thereby enhancing the airtightness of the compression chambers 8 defined between the two wrap portions 2D and 7B.

Incidentally, in the above-described scroll air compressor according to the prior art, the orbiting radius is adjusted by the variable crank 5 to press the wrap portion 7B of the orbiting scroll member 7 against the wrap portion 2D of the fixed scroll member 2. Therefore, the wrap portion 7B of the orbiting scroll member 7 contacts the wrap portion 2D of the fixed scroll member 2 at four contact points a to d, for example, as shown in FIG. 9.

At this time, at two contact points a and b among the four contact points a to d, the inner peripheral surface 7B1 of the wrap portion 7B of the orbiting scroll member 7 contacts the outer peripheral surface 2D2 of the wrap portion 2D of the fixed scroll member 2. At the other two contact points c and d, the outer peripheral surface 7B2 of the wrap portion 7B of the orbiting scroll member 7 contacts the inner peripheral surface 2D1 of the wrap portion 2D of the fixed scroll member 2.

Figure 9:
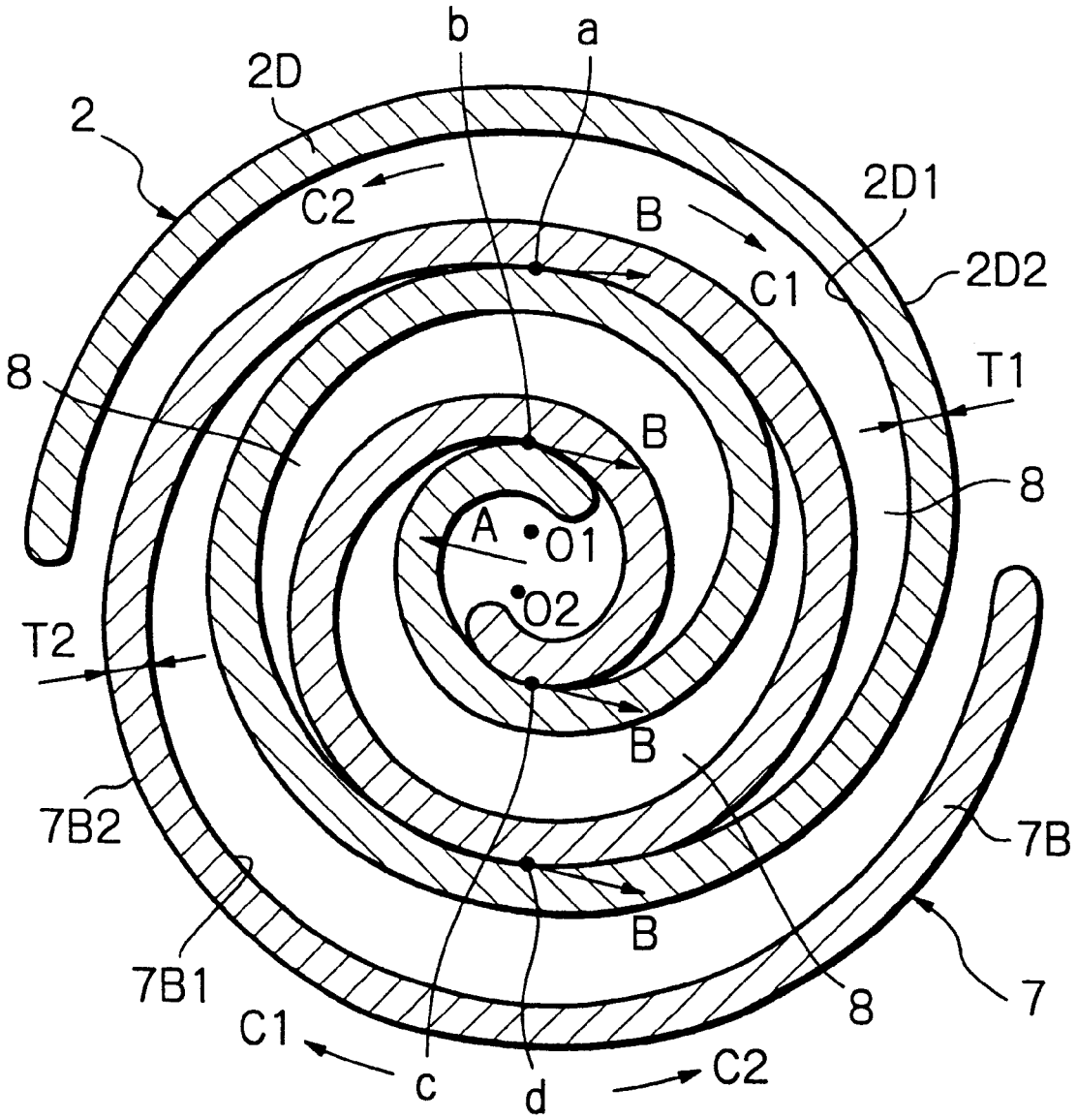
Fig. 9 PRIOR ART
FIG. 9 is a transverse sectional view as seen from the direction of the arrow IX—IX in FIG. 8, showing a wrap portion of a fixed scroll member and a wrap portion of an orbiting scroll member.

Assuming that the orbiting scroll member 7 moves in the direction of the arrow A in FIG. 9 as the driving shaft 3 rotates, frictional force acts at each of the contact points a to d of the orbiting scroll member 7 in the direction of the arrow B, which is opposite to the direction of the arrow A.

Although the rotation of the orbiting scroll member 7 is restrained by the movable plate 9 and so forth, the orbiting scroll member 7 is allowed to rotate slightly about the axis O2-O2 by backlash between the movable plate 9 and the guides 10 and 11. In addition, as the orbiting scroll member 7 orbits, rotational torque acts on the orbiting scroll member 7 in the direction of the arrow C1 in FIG. 9.

At the two contact points a and b, the frictional force and the rotational torque act on the orbiting scroll member 7 in the same direction. At the other two contact points c and d, the frictional force and the rotational torque act on the orbiting scroll member 7 in the opposite directions. Therefore, when the frictional force at the two contact points c and d increases, the orbiting scroll member 7 rotates slightly in the direction of the arrow C2 in FIG. 9 and thus vibrates slightly in the directions of the arrows C1 and C2. Consequently, the orbiting scroll member 7 repeats small vibration, and thus vibrations, noise, etc. increase unfavorably.

The present invention will be described below in detail with reference to FIGS. 1 to 7 and by way of embodiments in which an oilless scroll air compressor is taken as an example of a scroll fluid machine according to the present invention.

FIG. 1 shows a first embodiment of the present invention. In this embodiment, the same constituent elements as those in the above-described prior art are denoted by the same reference characters, and a description thereof is omitted.

A fixed scroll member 21 in this embodiment has a wrap portion 21A similar to the wrap portion 2D of the fixed scroll member 2 described above with regard to the prior art. The wrap portion 21A of the fixed scroll member 21 is formed in a spiral shape and has an inner peripheral surface 21A1 and an outer peripheral surface 21A2. The thickness T3 between the inner and outer peripheral surfaces 21A1 and 21A2 is set at an approximately uniform value over the entire length of the spiral shape.

An orbiting scroll member 22 is orbitably provided opposite to the fixed scroll member 21. The orbiting scroll member 22 has a wrap portion 22A similar to the wrap portion 7B of the orbiting scroll member 7 described above with regard to the prior art. The wrap portion 22A of the orbiting scroll member 22 is formed in a spiral shape similar to the wrap portion 21A of the fixed scroll member 21. However, the wrap portion 22A has its wall thickness increased at the inner peripheral surface (22A1) side thereof by a dimension ΔT. Consequently, the thickness T4 between the inner peripheral surface 22A1 and the outer peripheral surface 22A2 of the wrap portion 22A is larger than the thickness T3 of the wrap portion 21A of the fixed scroll member 21 by the dimension ΔT. Thus, the wrap portion 22A of the orbiting scroll member 22 differs from the wrap portion 21A of the fixed scroll member 21 in that the inner peripheral surface 22A1 of the wrap portion 22A is displaced closer to the axis O1-O1, which is the center of orbiting motion, than a surface (shown by the phantom line in FIG. 1) corresponding to the inner peripheral surface 21A1 of the fixed scroll member 21.

Thus, the inner peripheral surface 22A1 of the wrap portion 22A of the orbiting scroll member 22 is located closer to the axis O1-O1, which is the center of orbiting motion, than a surface (shown by the phantom line in FIG. 1) corresponding to the inner peripheral surface 21A1 of the wrap portion 21A of the fixed scroll member 21 by a dimension ΔT, e.g. on the order of from 10 μm to 100 μm, over the entire length of the wrap portion 22.

The orbiting scroll member 22 is installed so that the wrap portion 22A overlaps the wrap portion 21A of the fixed scroll member 21 with a predetermined offset angle (e.g. 180 degrees) in the rotational direction. Thus, a plurality of compression chambers 23 are defined between the two wrap portions 21A and 22A.

The inner peripheral surface 22A1 of the wrap portion 22A of the orbiting scroll member 22 contacts the outer peripheral surface 21A2 of the wrap portion 21A of the fixed scroll member 21 at two contact points a and b, for example. On the other hand, the outer peripheral surface 22A2 of the wrap portion 22A of the orbiting scroll member 22 is separate from the inner peripheral surface 21A1 of the wrap portion 21A of the fixed scroll member 21 over the entire length of the wrap portion 22A. Thus, a clearance is formed between the outer peripheral surface 22A2 of the wrap portion 22A of the orbiting scroll member 22 and the inner peripheral surface 21A1 of the wrap portion 21A of the fixed scroll member 21 along the entire length of the outer peripheral surface 22A2 of the wrap portion 22A.

Consequently, at positions which are approximately in radial symmetry with the contact points a and b with respect to the axis O1-O1, the outer peripheral surface 22A2 of the wrap portion 22A of the orbiting scroll member 22 and the inner peripheral surface 21A1 of the wrap portion 21A of the fixed scroll member 21 are closest to each other, but a small clearance e of the order of from 10 μm to 100 μm, for example, is formed between the outer peripheral surface 22A2 and the inner peripheral surface 21A1.

The scroll air compressor according to this embodiment has the above-described arrangement, and the basic operation thereof is not particularly different from that of the prior art.

In this embodiment, however, the inner peripheral surface 22A1 of the wrap portion 22A of the orbiting scroll member 22 is displaced closer to the axis O1-O1, which is the center of orbiting motion, than a surface corresponding to the inner peripheral surface 21A1 of the wrap portion 21A of the fixed scroll member 21. Consequently, the inner peripheral surface 22A1 of the wrap portion 22A of the orbiting scroll member 22 contacts the outer peripheral surface 21A2 of the wrap portion 21A of the fixed scroll member 21. In addition, because the inner peripheral surface 22A1 of the wrap portion 22A of the orbiting scroll member 22, which has its wall thickness increased at the inner peripheral surface side thereof, contacts the outer peripheral surface 21A2 of the wrap portion 21A of the fixed scroll member 21, at least a small clearance e can be formed between the outer peripheral surface 22A2 of the wrap portion 22A of the orbiting scroll member 22 and the inner peripheral surface 21A1 of the wrap portion 21A of the fixed scroll member 21.

Accordingly, when the orbiting scroll member 22 performs an orbiting motion in the direction of the arrow A, frictional force acting in the direction of the arrow B occurs at the two contact points a and b. In addition, rotational torque acts on the orbiting scroll member 22 in the direction of the arrow C1. At this time, the frictional force and the rotational torque act in approximately the same direction. There is no frictional force acting in the direction of the arrow C2, which is opposite to the direction of the rotational torque, as in the prior art. Therefore, a small vibration or the like does not occur in the orbiting scroll member 22. Accordingly, the orbiting scroll member 22 can orbit stably.

In addition, because the number of points a and b of contact between the fixed scroll member 21 and the orbiting scroll member 22 is reduced to approximately half of the number of contact points in the prior art, frictional force acting on the orbiting scroll member 22 can be reduced. Therefore, it is possible to reduce the power loss by the orbiting scroll member 22 and to improve the overall energy efficiency in the scroll air compressor.

Thus, according to this embodiment, the wall thickness of the wrap portion 22A of the orbiting scroll member 22 is increased at the inner peripheral surface (22A1) side thereof, so that the thickness T4 of the wrap portion 22A of the orbiting scroll member 22 is larger than the thickness T3 of the wrap portion 21A of the fixed scroll member 21. Therefore, the fixed scroll member 21 and the orbiting scroll member 22 can be brought into contact with each other only at positions where frictional force and rotational torque act in approximately the same direction. Accordingly, small vibration or the like does not occur in the orbiting scroll member 22. Thus, the orbiting scroll member 22 can orbit smoothly.

Figure 2:
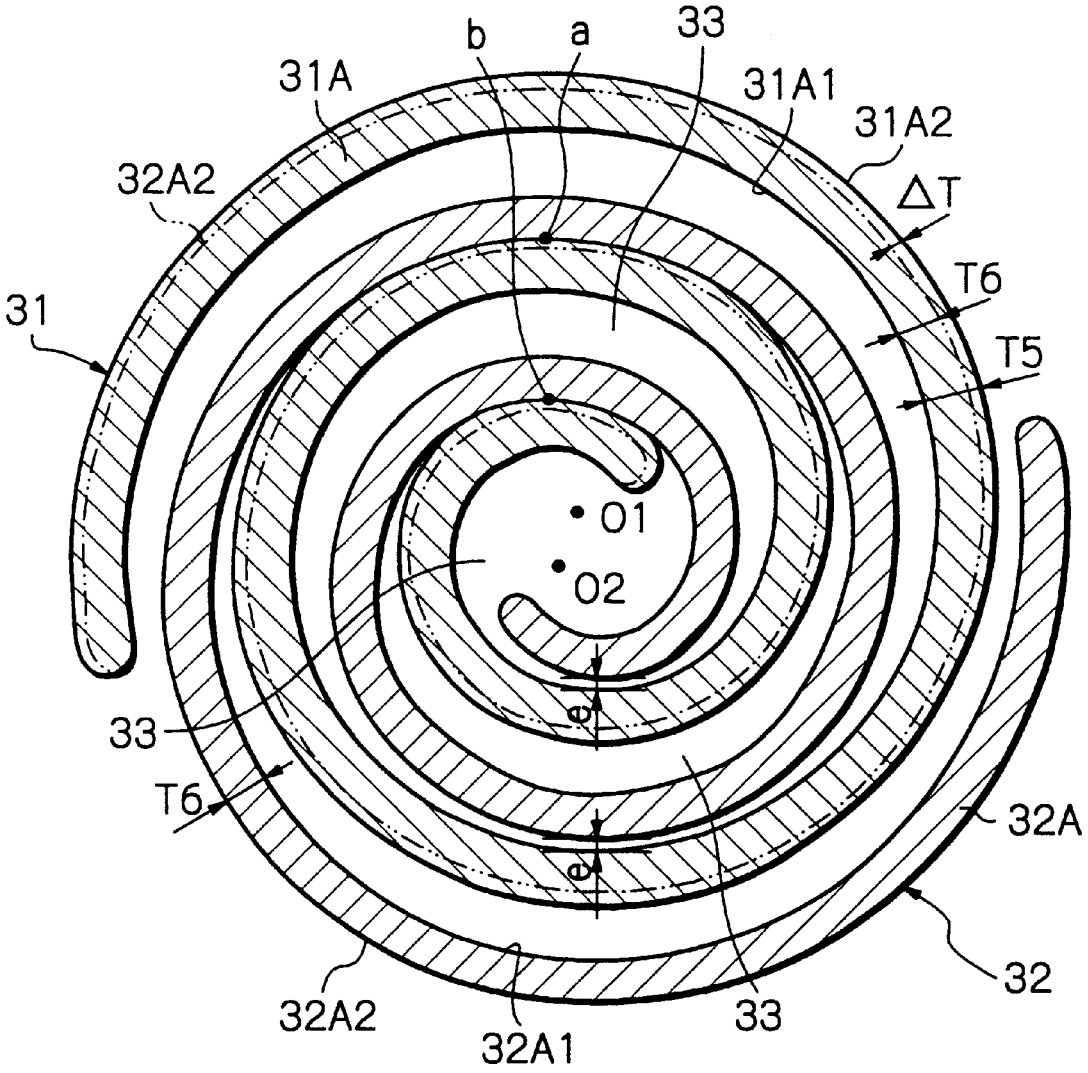
FIG. 2 is a transverse sectional view showing a wrap portion of an orbiting scroll member and a wrap portion of a fixed scroll member according to a second embodiment of the present invention.

FIG. 2 shows a second embodiment of the present invention. The feature of this embodiment resides in that the wall thickness of the wrap portion of the fixed scroll member is increased at the outer peripheral surface side thereof so that the thickness of the wrap portion of the fixed scroll member is larger than the thickness of the wrap portion of the orbiting scroll member. It should be noted that in this embodiment the same constituent elements as those in the above-described prior art are denoted by the same reference characters, and a description thereof is omitted.

A fixed scroll member 31 in this embodiment has a wrap portion 31A approximately similar to the wrap portion 2D of the fixed scroll member 2 described above with regard to the prior art. The wrap portion 31A of the fixed scroll member 31 is formed in a spiral shape. The thickness T5 between the inner peripheral surface 31A1 and the outer peripheral surface 31A2 of the wrap portion 31A is set at an approximately uniform value over the entire periphery.

The wrap portion 31A of the fixed scroll member 31 has its wall thickness increased at the outer peripheral surface (31A2) side thereof by a dimension ΔT. Consequently, the thickness T5 of the wrap portion 31A is larger than the thickness T6 of the wrap portion 32A of the orbiting scroll member 32 (described later). The outer peripheral surface 31A2 of the wrap portion 31A of the fixed scroll member 31 is displaced radially outward farther away from the axis O1-O1, which is the center of orbiting motion, than a surface (shown by the phantom line in FIG. 2) corresponding to the outer peripheral surface 32A2 of the wrap portion 32A of the orbiting scroll member 32.

Thus, the outer peripheral surface 31A2 of the wrap portion 31A of the fixed scroll member 31 lies radially farther out than a surface (shown by the phantom line in FIG. 2) corresponding to the outer peripheral surface 32A2 of the wrap portion 32A of the orbiting scroll member 32 by a dimension ΔT, e.g. on the order of from 10 μm to 100 μm, over the entire length of the periphery.

The orbiting scroll member 32 is orbitably provided opposite to the fixed scroll member 31. The orbiting scroll member 32 has a wrap portion 32A similar to the wrap portion 7B of the orbiting scroll member 7 described above with regard to the prior art. The wrap portion 32A of the orbiting scroll member 32 is formed in a spiral shape similar to the wrap portion 31A of the fixed scroll member 31. In addition, the thickness T6 between the inner peripheral surface 32A1 and the outer peripheral surface 32A2 is set at a value smaller than the thickness T5 of the wrap portion 31A of the fixed scroll member 31 over the entire length of the periphery.

The orbiting scroll member 32 is installed so that the wrap portion 32A overlaps the wrap portion 31A of the fixed scroll member 31 with a predetermined offset angle (e.g. 180 degrees) in the rotational direction. Thus, a plurality of compression chambers 33 are defined between the two wrap portions 31A and 32A.

The inner peripheral surface 32A1 of the wrap portion 32A of the orbiting scroll member 32 contacts the outer peripheral surface 31A2 of the wrap portion 31A of the fixed scroll member 31 at two contact points a and b, for example. On the other hand, the outer peripheral surface 32A2 of the wrap portion 32A of the orbiting scroll member 32 is separate from the inner peripheral surface 31A1 of the wrap portion 31A of the fixed scroll member 31 over the entire periphery. Even in a region where the two wrap portions 32A and 31A are closest to each other, a small clearance e of the order of from 10 $\mu$m to 100 $\mu$m, for example, is formed between the outer peripheral surface 32A2 of the wrap portion 32A of the orbiting scroll member 32 and the inner peripheral surface 31A1 of the wrap portion 31A of the fixed scroll member 31.

Thus, with this embodiment also, advantageous effects similar to those in the first embodiment can be obtained.

Figure 3:
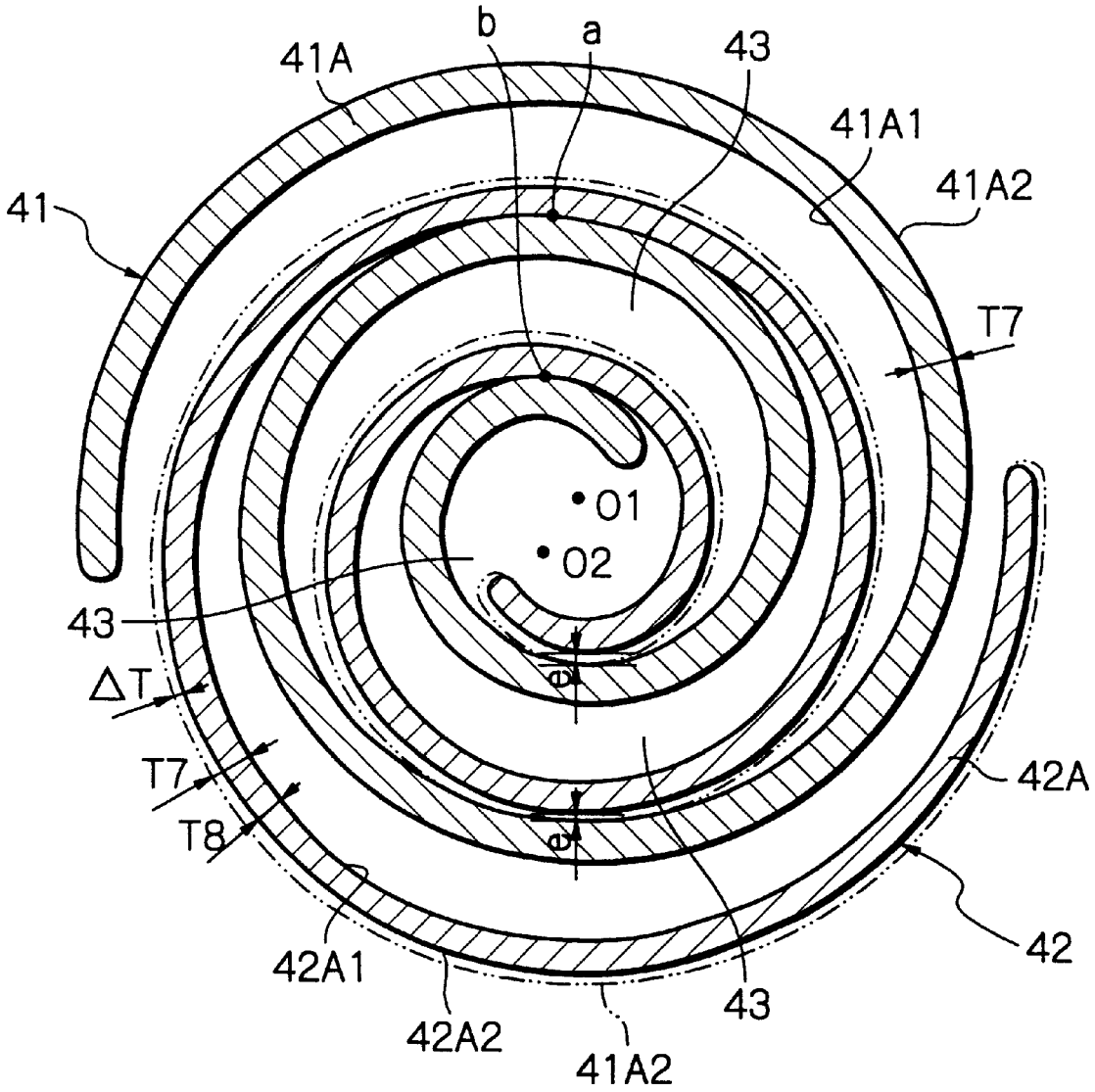
FIG. 3 is a transverse sectional view showing a wrap portion of an orbiting scroll member and a wrap portion of a fixed scroll member according to a third embodiment of the present invention.

FIG. 3 shows a third embodiment of the present invention. The feature of this embodiment resides in that the wall thickness of the wrap portion of the orbiting scroll member is reduced at the outer peripheral surface side thereof so that the thickness of the wrap portion of the orbiting scroll member is smaller than the thickness of the wrap portion of the fixed scroll member. It should be noted that in this embodiment the same constituent elements as those in the above-described prior art are denoted by the same reference characters, and a description thereof is omitted.

A fixed scroll member 41 in this embodiment has a wrap portion 41A similar to the wrap portion 2D of the fixed scroll member 2 described above with regard to the prior art. The wrap portion 41A of the fixed scroll member 41 is formed in a spiral shape. The thickness T7 between the inner peripheral surface 41A1 and the outer peripheral surface 41A2 of the wrap portion 41A is set at an approximately uniform value over the entire periphery.

An orbiting scroll member 42 is orbitably provided opposite to the fixed scroll member 41. The orbiting scroll member 42 has a wrap portion 42A similar to the wrap portion 7B of the orbiting scroll member 7 described above with regard to the prior art. The wrap portion 42A of the orbiting scroll member 42 is formed in a spiral shape similar to the wrap portion 41A of the fixed scroll member 41. However, the wrap portion 42A of the orbiting scroll member 42 has its wall thickness reduced at the outer peripheral surface (42A2) side thereof so that the thickness T8 between the inner peripheral surface 42A1 and the outer peripheral surface 42A2 is smaller than the thickness T7 of the wrap portion 41A of the fixed scroll member 41. In addition, the outer peripheral surface member 42A2 of the wrap portion 42A of the orbiting scroll member 42 is displaced closer to the axis O1-O1, which is the center of orbiting motion, than a surface (shown by the phantom line in FIG. 3) corresponding to the outer peripheral surface 41A2 of the wrap portion 41A of the fixed scroll member 41.

Thus, the outer peripheral surface 42A2 of the wrap portion 42A of the orbiting scroll member 42 is located closer to the axis O1-O1 than a surface (shown by the phantom line in FIG. 3) corresponding to the outer peripheral surface 41A2 of the wrap portion 41A of the fixed scroll member 41 by a dimension $\Delta$T, e.g. on the order of from 10 $\mu$m to 100 $\mu$m, over the entire periphery.

The orbiting scroll member 42 is installed so that the wrap portion 42A overlaps the wrap portion 41A of the fixed scroll member 41 with a predetermined offset angle (e.g. 180 degrees) in the rotational direction. Thus, a plurality of compression chambers 43 are defined between the two wrap portions 41A and 42A.

The inner peripheral surface 42A1 of the wrap portion 42A of the orbiting scroll member 42 contacts the outer peripheral surface 41A2 of the wrap portion 41A of the fixed scroll member 41 at two contact points a and b, for example. On the other hand, the outer peripheral surface 42A2 of the wrap portion 42A of the orbiting scroll member 42 is separate from the inner peripheral surface 41A1 of the wrap portion 41A of the fixed scroll member 41 over the entire periphery. Even in a region where the two wrap portions 42A and 41A are closest to each other, a small clearance e of the order of from 10 $\mu$m to 100 $\mu$m, for example, is formed between the outer peripheral surface 42A2 of the wrap portion 42A of the orbiting scroll member 42 and the inner peripheral surface 41A1 of the wrap portion 41A of the fixed scroll member 41.

Thus, with this embodiment also, advantageous effects approximately similar to those in the first embodiment can be obtained.

Figure 4:
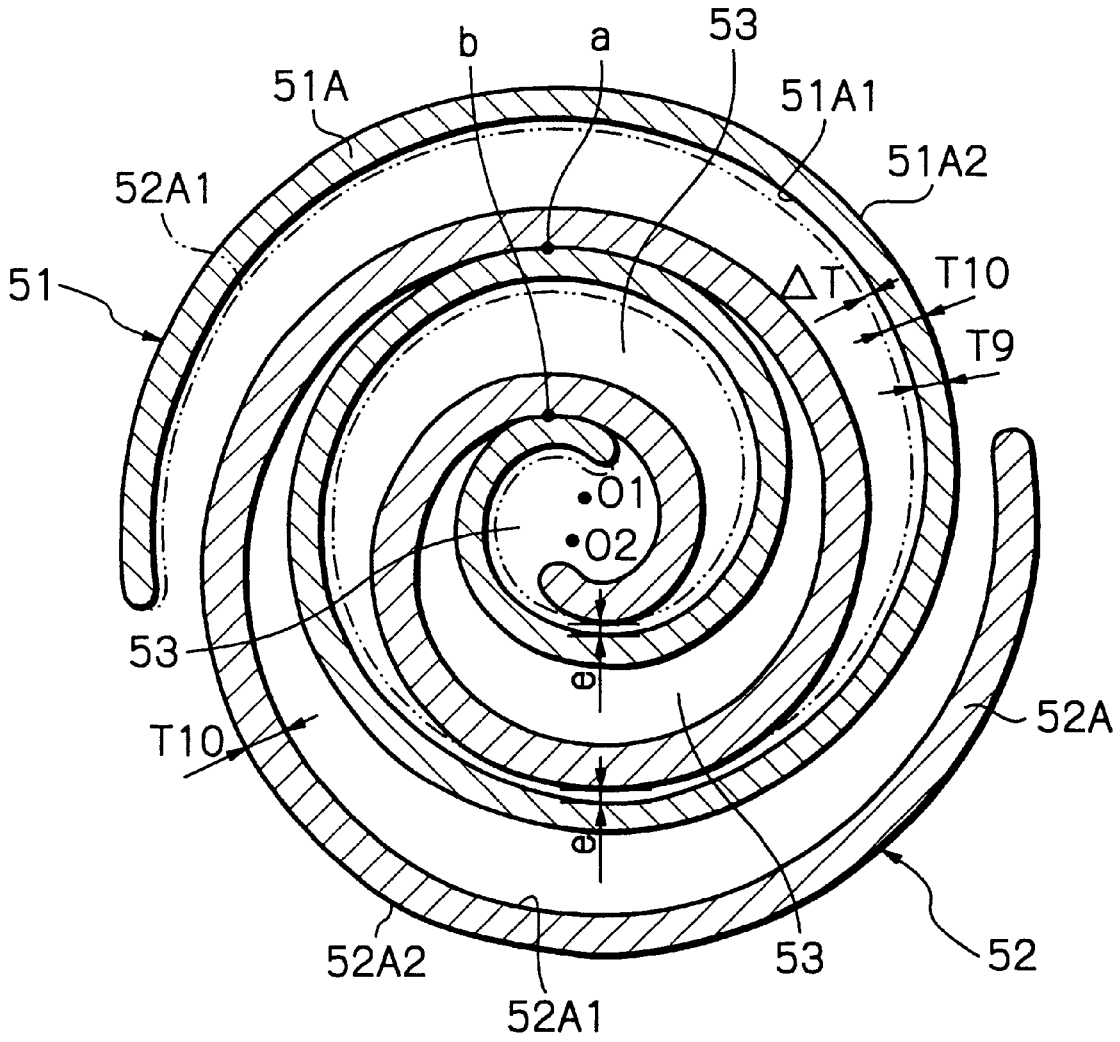
FIG. 4 is a transverse sectional view showing a wrap portion of an orbiting scroll member and a wrap portion of a fixed scroll member according to a fourth embodiment of the present invention.

FIG. 4 shows a fourth embodiment of the present invention. The feature of this embodiment resides in that the wall thickness of the wrap portion of the fixed scroll member is reduced at the inner peripheral surface side thereof so that the thickness of the wrap portion of the fixed scroll member is smaller than the thickness of the wrap portion of the orbiting scroll member. It should be noted that in this embodiment the same constituent elements as those in the above-described prior art are denoted by the same reference characters, and a description thereof is omitted.

A fixed scroll member 51 in this embodiment has a wrap portion 51A similar to the wrap portion 2D of the fixed scroll member 2 described above with regard to the prior art. The wrap portion 51A of the fixed scroll member 51 is formed in a spiral shape. The thickness T9 between the inner peripheral surface 51A1 and the outer peripheral surface 51A2 of the wrap portion 51A is set at an approximately uniform value over the entire periphery.

The wrap portion 51A of the fixed scroll member 51 has its wall thickness reduced at the inner peripheral surface (51A1) side thereof so that the thickness T9 of the wrap portion 51A is smaller than the thickness T10 of the wrap portion 52A of the orbiting scroll member 52 (described later). In addition, the inner peripheral surface 51A1 of the wrap portion 51A of the fixed scroll member 51 is displaced radially outward farther away from the axis O1-O1, which is the center of orbiting motion, than a surface (shown by the phantom line in FIG. 4) corresponding to the inner peripheral surface 52A1 of the wrap portion 52A of the orbiting scroll member 52.

Thus, the inner peripheral surface 51A1 of the wrap portion 51A of the fixed scroll member 51 is located farther away from the axis O1-O1 radially outward than a surface (shown by the phantom line in FIG. 4) corresponding to the inner peripheral surface 52A1 of the wrap portion 52A of the orbiting scroll member 52 by a dimension ΔT, e.g. on the order of from 10 μm to 100 μm, over the entire periphery.

The orbiting scroll member 52 is orbitably provided opposite to the fixed scroll member 51. The orbiting scroll member 52 has a wrap portion 52A similar to the wrap portion 7B of the orbiting scroll member 7 described above with regard to the prior art. The wrap portion 52A of the orbiting scroll member 52 is formed in a spiral shape similar to the wrap portion 51A of the fixed scroll member 51. In addition, the thickness T10 between the inner peripheral surface 52A1 and the outer peripheral surface 52A2 is set at a value larger than the thickness T9 of the wrap portion 51A of the fixed scroll member 51.

The orbiting scroll member 52 is installed so that the wrap portion 52A overlaps the wrap portion 51A of the fixed scroll member 51 with a predetermined offset angle (e.g. 180 degrees) in the rotational direction. Thus, a plurality of compression chambers 53 are defined between the two wrap portions 51A and 52A.

The inner peripheral surface 52A1 of the wrap portion 52A of the orbiting scroll member 52 contacts the outer peripheral surface 51A2 of the wrap portion 51A of the fixed scroll member 51 at two contact points a and b, for example. On the other hand, the outer peripheral surface 52A2 of the wrap portion 52A of the orbiting scroll member 52 is separate from the inner peripheral surface 51A1 of the wrap portion 51A of the fixed scroll member 51 over the entire length of the peripheral surfaces. Even in a region where the two wrap portions 52A and 51A are closest to each other, a small clearance e of the order of from 10 μm to 100 μm, for example, is formed between the outer peripheral surface 52A2 of the wrap portion 52A of the orbiting scroll member 52 and the inner peripheral surface 51A1 of the wrap portion 51A of the fixed scroll member 51.

Thus, with this embodiment also, advantageous effects similar to those in the first embodiment can be obtained.

Figure 5:
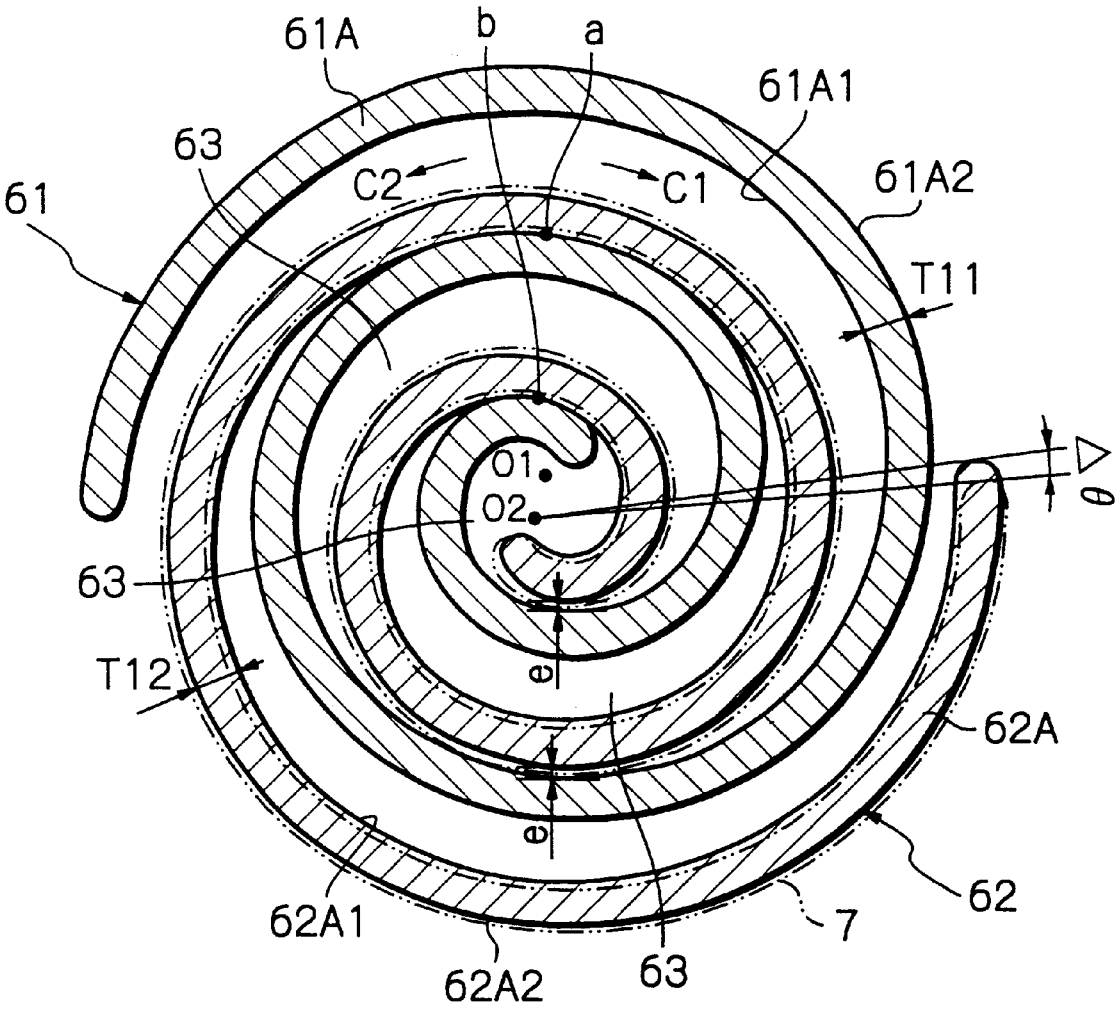
FIG. 5 is a transverse sectional view showing a wrap portion of an orbiting scroll member and a wrap portion of a fixed scroll member according to a fifth embodiment of the present invention.

FIG. 5 shows a fifth embodiment of the present invention. The feature of this embodiment resides in that the wrap portion of the orbiting scroll member is provided out of phase with respect to the wrap portion of the fixed scroll member by a small angle in the circumferential direction. It should be noted that in this embodiment the same constituent elements as those in the above-described prior art are denoted by the same reference characters, and a description thereof is omitted.

A fixed scroll member 61 in this embodiment has a wrap portion 61A similar to the wrap portion 2D of the fixed scroll member 2 described above with regard to the prior art. The wrap portion 61A of the fixed scroll member 61 is formed in a spiral shape. The thickness T11 between the inner and outer peripheral surfaces 61A1 and 61A2 of the wrap portion 61A is set at an approximately uniform value over the entire length of the periphery.

An orbiting scroll member 62 is orbitably provided opposite to the fixed scroll member 61. The orbiting scroll member 62 has a wrap portion 62A similar to the wrap portion 7B of the orbiting scroll member 7 described above with regard to the prior art. The wrap portion 62A of the orbiting scroll member 62 is formed in a spiral shape similar to the wrap portion 61A of the fixed scroll member 61. The thickness T12 between the inner and outer peripheral surfaces 62A1 and 62A2 of the wrap portion 62A is set at a value approximately equal to the thickness T11 of the wrap portion 61A of the fixed scroll member 61 over the entire length of the periphery.

The wrap portion 62A of the orbiting scroll member 62 is circumferentially phase-shifted by a small angle Δθ, for example, in the direction of the arrow C2 (counterclockwise direction), which is opposite to the direction of the arrow C1 (clockwise direction) in which rotational torque acts, about the axis O2-O2 as the center of the orbiting scroll member 62.

Consequently, the wrap portion 62A of the orbiting scroll member 62 has been rotated by the small angle Δθ relative to the wrap portion 7B of the orbiting scroll member 7 according to the prior art, which is shown by the phantom line in FIG. 5. In other words, the orbiting scroll member 62 is positioned so that the wrap portion 62A overlaps the wrap portion 61A of the fixed scroll member 61 with an offset angle smaller than 180 degrees (for example) by the small angle Δθ in the rotational direction. Thus, a plurality of compression chambers 63 are defined between the two wrap portions 61A and 62A.

The inner peripheral surface 62A1 of the wrap portion 62A of the orbiting scroll member 62 contacts the outer peripheral surface 61A2 of the wrap portion 61A of the fixed scroll member 61 at two contact points a and b, for example. On the other hand, the outer peripheral surface 62A2 of the wrap portion 62A of the orbiting scroll member 62 is separate from the inner peripheral surface 61A1 of the wrap portion 61A of the fixed scroll member 61 over the entire length of the peripheral surfaces. Even in a region where the two wrap portions 62A and 61A are closest to each other, a small clearance e of the order of from 10 μm to 100 μm, for example, is formed between the outer peripheral surface 62A2 of the wrap portion 62A of the orbiting scroll member 62 and the inner peripheral surface 61A1 of the wrap portion 61A of the fixed scroll member 61.

Thus, with this embodiment also, advantageous effects similar to those in the first embodiment can be obtained.

Figure 6:
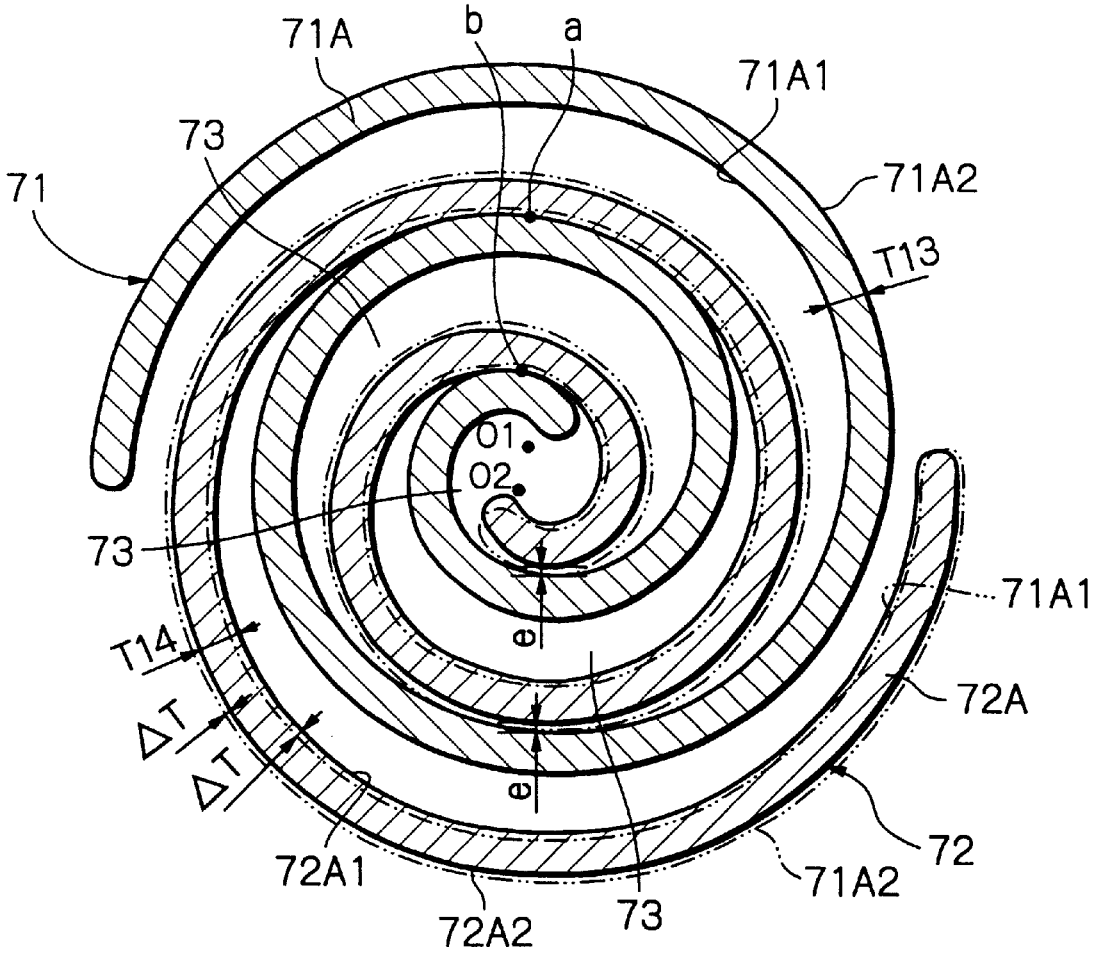
FIG. 6 is a transverse sectional view showing a wrap portion of an orbiting scroll member and a wrap portion of a fixed scroll member according to a sixth embodiment of the present invention.

FIG. 6 shows a sixth embodiment of the present invention. The feature of this embodiment resides in that the wall thickness of the wrap portion of the orbiting scroll member is increased at the inner peripheral surface side thereof and reduced at the outer peripheral surface side thereof so that the thickness of the wrap portion of the orbiting scroll member is approximately equal to the thickness of the wrap portion of the fixed scroll member. It should be noted that in this embodiment the same constituent elements as those in the above-described prior art are denoted by the same reference characters, and a description thereof is omitted.

A fixed scroll member 71 in this embodiment has a wrap portion 71A similar to the wrap portion 2D of the fixed scroll member 2 described above with regard to the prior art. The wrap portion 71A of the fixed scroll member 71 is formed in a spiral shape. The thickness T13 between the inner peripheral surface 71A1 and the outer peripheral surface 71A2 of the wrap portion 71A is set at an approximately uniform value over the entire length of the peripheral surfaces.

An orbiting scroll member 72 is orbitably provided opposite to the fixed scroll member 71. The orbiting scroll member 72 has a wrap portion 72A similar to the wrap portion 7B of the orbiting scroll member 7 described above with regard to the prior art. The wrap portion 72A of the orbiting scroll member 72 is formed in a spiral shape similar to the wrap portion 71A of the fixed scroll member 71. However, the wrap portion 72A of the orbiting scroll member 72 has its wall thickness increased at the inner peripheral surface (72A1) side thereof and reduced at the outer peripheral surface (72A2) side thereof. Consequently, the thickness T14 between the inner and outer peripheral surfaces 72A1 and 72A2 of the wrap portion 72A is approximately equal to the thickness T13 of the wrap portion 71A of the fixed scroll member 71.

The inner and outer peripheral surfaces 72A1 and 72A2 of the wrap portion 72A of the orbiting scroll member 72 are displaced closer to the axis O1-O1, which is the center of orbiting motion, than surfaces (shown by the phantom lines in FIG. 6) corresponding respectively to the inner and outer peripheral surfaces 71A1 and 71A2 of the wrap portion 71A of the fixed scroll member 71. Therefore, the inner peripheral surface 72A1 of the wrap portion 72A of the orbiting scroll member 72 is located closer to the axis O1-O1 than the surface (shown by the phantom line in FIG. 6) corresponding to the inner peripheral surface 71A1 of the wrap portion 71A of the fixed scroll member 71 by a dimension ΔT, e.g. on the order of from 10 μm to 100 μm, over the entire length of the peripheral surfaces. In addition, the outer peripheral surface 72A2 of the wrap portion 72A of the orbiting scroll member 72 is located closer to the axis O1-O1 than the surface (shown by the phantom line in FIG. 6) corresponding to the outer peripheral surface 71A2 of the wrap portion 71A of the fixed scroll member 71 by a dimension ΔT, e.g. on the order of from 10 μm to 100 μm, over the entire length of the peripheral surfaces.

The orbiting scroll member 72 is installed so that the wrap portion 72A overlaps the wrap portion 71A of the fixed scroll member 71 with a predetermined offset angle (e.g. 180 degrees) in the rotational direction. Thus, a plurality of compression chambers 73 are defined between the two wrap portions 71A and 72A.

The inner peripheral surface 72A1 of the wrap portion 72A of the orbiting scroll member 72 contacts the outer peripheral surface 71A2 of the wrap portion 71A of the fixed scroll member 71 at two contact points a and b, for example. On the other hand, the outer peripheral surface 72A2 of the wrap portion 72A of the orbiting scroll member 72 is separate from the inner peripheral surface 71A1 of the wrap portion 71A of the fixed scroll member 71 over the entire length of the peripheral surfaces. Even in a region where the two wrap portions 72A and 71A are closest to each other, a small clearance e of the order of from 10 μm to 100 μm, for example, is formed between the outer peripheral surface 72A2 of the wrap portion 72A of the orbiting scroll member 72 and the inner peripheral surface 71A1 of the wrap portion 71A of the fixed scroll member 71.

Thus, with this embodiment also, advantageous effects similar to those in the first embodiment can be obtained.

Figure 7:
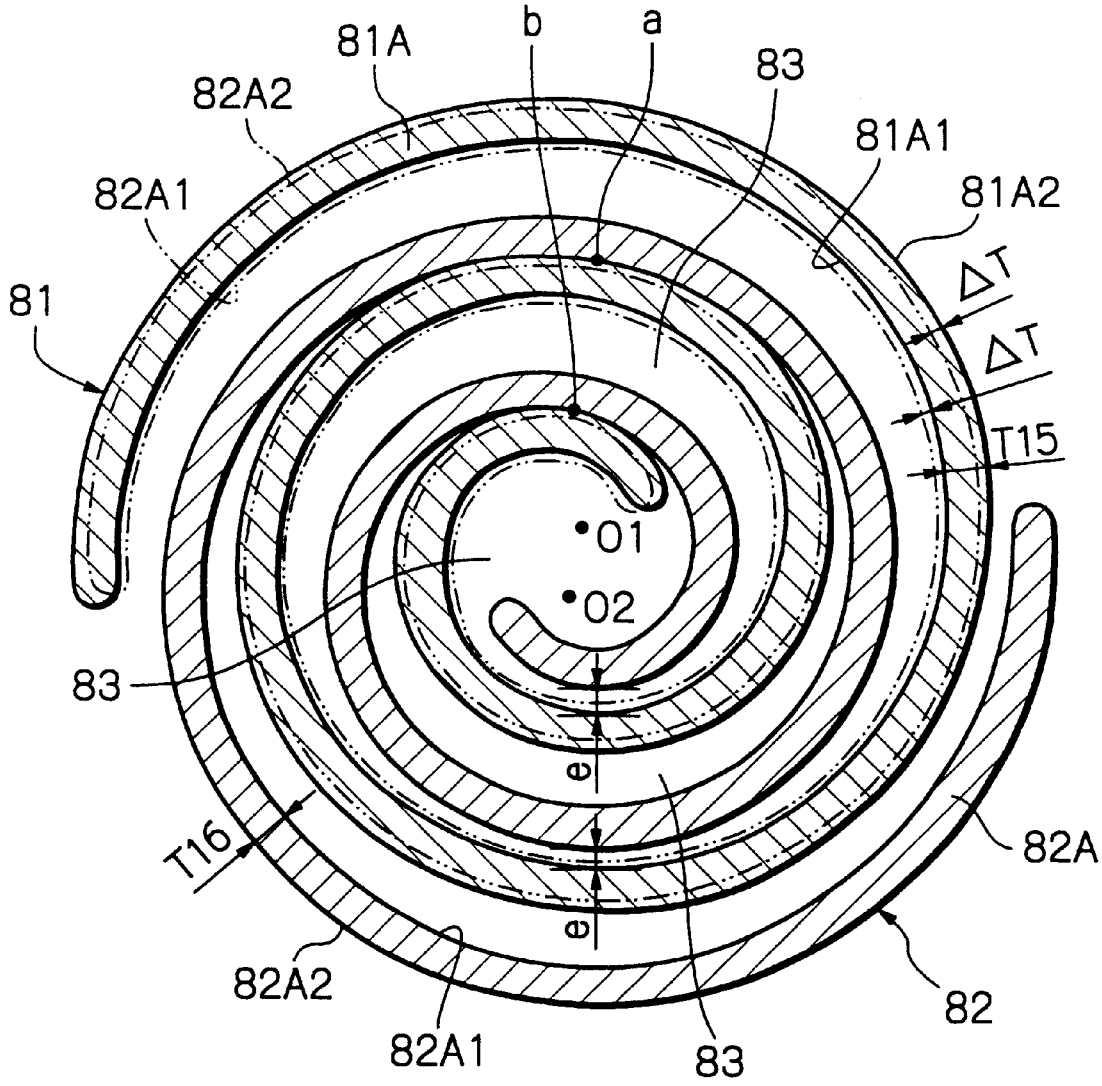
FIG. 7 is a transverse sectional view showing a wrap portion of an orbiting scroll member and a wrap portion of a fixed scroll member according to a seventh embodiment of the present invention.

FIG. 7 shows a seventh embodiment of the present invention. The feature of this embodiment resides in that the wall thickness of the wrap portion of the fixed scroll member is reduced at the inner peripheral surface side thereof and increased at the outer peripheral surface side thereof so that the thickness of the wrap portion of the fixed scroll member is approximately equal to the thickness of the wrap portion of the orbiting scroll member. It should be noted that in this embodiment the same constituent elements as those in the above-described prior art are denoted by the same reference characters, and a description thereof is omitted.

A fixed scroll member 81 in this embodiment has a wrap portion 81A similar to the wrap portion 2D of the fixed scroll member 2 described above with regard to the prior art. The wrap portion 81A of the fixed scroll member 81 is formed in a spiral shape. The thickness T15 between the inner peripheral surface 81A1 and the outer peripheral surface 81A2 of the wrap portion 81A is set at an approximately uniform value over the entire periphery.

The wrap portion 81A of the fixed scroll member 81 has its wall thickness reduced at the inner peripheral surface (81A1) side thereof and increased at the outer peripheral surface (81A2) side thereof. Consequently, the thickness T15 of the wrap portion 81A is approximately equal to the thickness T16 of the wrap portion 82A of the orbiting scroll member 82 (described later). The inner and outer peripheral surfaces 81A1 and 81A2 of the wrap portion 81A of the fixed scroll member 81 are displaced radially outward farther away from the axis O1-O1, which is the center of orbiting motion, than surfaces (shown by the phantom lines in FIG. 7) respectively corresponding to the inner and outer peripheral surfaces 82A1 and 82A2 of the wrap portion 82A of the orbiting scroll member 82.

Therefore, the inner peripheral surface 81A1 of the wrap portion 81A of the fixed scroll member 81 lies radially farther out from the axis O1-O1 than the surface (shown by the phantom line in FIG. 7) corresponding to the inner peripheral surface 82A1 of the wrap portion 82A of the orbiting scroll member 82 by a dimension ΔT, e.g. on the order of from 10 μm to 100 μm, over the entire length of the peripheral surfaces. In addition, the outer peripheral surface 81A2 of the wrap portion 81A of the fixed scroll member 81 lies radially farther out from the axis O1-O1 than the surface (shown by the phantom line in FIG. 7) corresponding to the outer peripheral surface 82A2 of the wrap portion 82A of the orbiting scroll member 82 by a dimension ΔT, e.g. on the order of from 10 μm to 100 μm, over the entire periphery.

The orbiting scroll member 82 is orbitably provided opposite to the fixed scroll member 81. The orbiting scroll member 82 has a wrap portion 82A approximately similar to the wrap portion 7B of the orbiting scroll member 7 described above with regard to the prior art. The wrap portion 82A of the orbiting scroll member 82 is formed in a spiral shape similar to the wrap portion 81A of the fixed scroll member 81. The thickness T16 between the inner and outer peripheral surfaces 82A1 and 82A2 of the wrap portion 81A is set at a value approximately equal to the thickness T15 of the wrap portion 81A of the fixed scroll member 81.

The orbiting scroll member 82 is installed so that the wrap portion 82A overlaps the wrap portion 81A of the fixed scroll member 81 with a predetermined offset angle (e.g. 180 degrees) in the rotational direction. Thus, a plurality of compression chambers 83 are defined between the two wrap portions 81A and 82A.

The inner peripheral surface 82A1 of the wrap portion 82A of the orbiting scroll member 82 contacts the outer peripheral surface 81A2 of the wrap portion 81A of the fixed scroll member 81 at two contact points a and b, for example. On the other hand, the outer peripheral surface 82A2 of the wrap portion 82A of the orbiting scroll member 82 is separate from the inner peripheral surface 81A1 of the wrap portion 81A of the fixed scroll member 81 over the entire length of the peripheral surfaces. Even in a region where the two wrap portions 82A and 81A are closest to each other, a small clearance e of the order of from 10 μm to 100 μm, for example, is formed between the outer peripheral surface 82A2 of the wrap portion 82A of the orbiting scroll member 82 and the inner peripheral surface 81A1 of the wrap portion 81A of the fixed scroll member 81.

Thus, with this embodiment also, advantageous effects similar to those in the first embodiment can be obtained.

Although in the above-described fifth embodiment the wrap portion 62A of the orbiting scroll member 62 is circumferentially phase-shifted by a small angle Δθ in the counterclockwise direction about the axis O2-O2, the present invention is not necessarily limited to the described arrangement. The arrangement may be such that the wrap portion of the fixed scroll member is circumferentially phase-shifted by a small angle in the clockwise direction about the center of orbiting motion (i.e. the axis O1-O1), which is the center of the fixed scroll member.

Although in the foregoing embodiments the present invention has been described with regard to a scroll air compressor as an example of a scroll fluid machine, the present invention is not necessarily limited to the scroll air compressor, but may also be widely applied to other scroll fluid machines, e.g. a vacuum pump, a refrigerant compressor, etc.

As has been detailed above, according to the present invention, the inner peripheral surface of the wrap portion of the orbiting scroll member and the outer peripheral surface of the wrap portion of the fixed scroll member contact each other at at least some region in the circumferential direction thereof, and a clearance is formed between the outer peripheral surface of the wrap portion of the orbiting scroll member and the inner peripheral surface of the wrap portion of the fixed scroll member over the entire length of the peripheral surfaces. Consequently, the fixed scroll member and the orbiting scroll member can be brought into contact with each other only where frictional force and rotational torque act in approximately the same direction. Therefore, small vibration or the like does not occur in the orbiting scroll member. Accordingly, the orbiting scroll member can orbit smoothly.

What is claimed is:

1. A scroll fluid machine comprising:

a casing;

a fixed scroll member provided in said casing, said fixed scroll member having a spiral fixed wrap portion standing on an end plate;

a driving shaft rotatably mounted in said casing, said driving shaft having a fitting portion at a distal end thereof;

an orbiting scroll member orbitably mounted on said distal end of said driving shaft, said orbiting scroll member having a spiral orbiting wrap portion standing on a front side of an end plate, said orbiting wrap portion having a larger wall thickness than a wall thickness of said fixed wrap portion by increasing said wall thickness at an inner peripheral surface of said orbiting wrap portion, said orbiting wrap portion overlapping said fixed wrap portion of said fixed scroll member so as to define a plurality of compression chambers, said orbiting scroll member further having a boss portion provided on a rear side of said end plate for connection with said fitting portion of said driving shaft; and an orbiting radius varying mechanism connected to said fitting portion of said driving shaft and said boss portion of said orbiting scroll member so as to vary an orbiting radius of said orbiting scroll member;

wherein said orbiting wrap portion and said fixed wrap portion are arranged such that said inner peripheral surface of said orbiting wrap portion of said orbiting scroll member and an outer peripheral surface of said fixed wrap portion of said fixed scroll member contact each other at at least a point in a circumferential direction of said orbiting wrap portion and said fixed wrap portion, and such that a clearance is formed between an outer peripheral surface of said orbiting wrap portion of said orbiting scroll member and an inner peripheral surface of said fixed wrap portion of said fixed scroll member over an entire length of said outer peripheral surface of said orbiting wrap portion and said inner peripheral surface of said fixed wrap portion.

2. A scroll fluid machine according to claim 1, wherein said orbiting radius varying mechanism comprises a crank member having a first shaft portion rotatably fitted into a hole eccentrically formed in said driving shaft, and a second shaft portion eccentric with respect to said first shaft portion and fitted to the boss portion of said orbiting scroll member.

3. A scroll fluid machine comprising:

a casing;

a fixed scroll member provided in said casing, said fixed scroll member having a spiral fixed wrap portion standing on an end plate;

a driving shaft rotatably mounted in said casing, said driving shaft having a fitting portion at a distal end thereof;

an orbiting scroll member orbitably mounted on said distal end of said driving shaft, said orbiting scroll member having a spiral orbiting wrap portion standing on a front side of an end plate, said fixed wrap portion of said fixed scroll member being formed with a smaller wall thickness than a wall thickness of said orbiting wrap portion of said orbiting scroll member by reducing said wall thickness of said fixed wrap portion of said fixed scroll member at an innerperipheral surface thereof, said orbiting wrap portion overlapping said fixed wrap portion of said fixed scroll member so as to define a plurality of compression chambers, said orbiting scroll member further having a boss portion provided on a rear side of said end plate for connection with said fitting portion of said driving shaft; and an orbiting radius varying mechanism connected to said fitting portion of said driving shaft and said boss portion of said orbiting scroll member so as to vary an orbiting radius of said orbiting scroll member;

wherein said orbiting wrap portion and said fixed wrap portion are arranged such that an inner peripheral surface of said orbiting wrap portion of said orbiting scroll member and an outer peripheral surface of said fixed wrap portion of said fixed scroll member contact each other at at least a point in a circumferential direction of said orbiting wrap portion and said fixed wrap portion, and such that a clearance is formed between an outer peripheral surface of said orbiting wrap portion of said orbiting scroll member and said inner peripheral surface of said fixed wrap portion of said fixed scroll member over an entire length of said outer peripheral surface of said orbiting wrap portion and said inner peripheral surface of said fixed wrap portion.

4. A scroll fluid machine according to claim 3, wherein said orbiting radius varying mechanism comprises a crank member having a first shaft portion rotatably fitted into a hole eccentrically formed in said driving shaft, and a second shaft portion eccentric with respect to said first shaft portion and fitted to the boss portion of said orbiting scroll member.

5. A scroll fluid machine comprising:

a casing;

a fixed scroll member provided in said casing, said fixed scroll member having a spiral fixed wrap portion standing on an end plate;

a driving shaft rotatable mounted in said casing, said driving shaft having a fitting portion at a distal end thereof;

an orbiting scroll member orbitably mounted on said distal end of said driving shaft, said orbiting scroll member having a spiral orbiting wrap portion standing on a front side of an end plate, said orbiting wrap portion of said orbiting scroll member being formed with a smaller wall thickness than a wall thickness of said fixed wrap portion of said fixed scroll member by reducing said wall thickness of said orbiting wrap portion of said orbiting scroll member at an outer peripheral surface thereof, said orbiting wrap portion overlapping said fixed wrap portion of said fixed scroll member so as to define a plurality of compression chambers, said orbiting scroll member further having a boss portion provided on a rear side of said end plate for connection with said fitting portion of said driving shaft; and an orbiting radius varying mechanism connected to said fitting portion of said driving shaft and said boss portion of said orbiting scroll member so as to vary an orbiting radius of said orbiting scroll member;

wherein said orbiting wrap portion and said fixed wrap portion are arranged such that an inner peripheral surface of said orbiting wrap portion of said orbiting scroll member and an outer peripheral surface of said fixed wrap portion of said fixed scroll member contact each other at at least a point in a circumferential direction of said orbiting wrap portion and said fixed wrap portion, and such that a clearance is formed between said outer peripheral surface of said orbiting wrap portion of said orbiting scroll member and an inner peripheral surface of said fixed wrap portion of said fixed scroll member over an entire length of said outer peripheral surface of said orbiting wrap portion and said inner peripheral surface of said fixed wrap portion.

6. A scroll fluid machine according to claim 5, wherein said orbiting radius varying mechanism comprises a crank member having a first shaft portion rotatably fitted into a hole eccentrically formed in said driving shaft, and a second shaft portion eccentric with respect to said first shaft portion and fitted to the boss portion of said orbiting scroll member.

7. A scroll fluid machine comprising:

a casing;

a fixed scroll member provided in said casing, said fixed scroll member having a spiral fixed wrap portion standing on an end plate;

a driving shaft rotatable mounted in said casing, said driving shaft having a fitting portion at a distal end thereof;

an orbiting scroll member orbitably mounted on said distal end of said driving shaft, said orbiting scroll member having a spiral orbiting wrap portion standing on a front side of an end plate, said fixed wrap portion of said fixed scroll member being formed with a larger wall thickness than a wall thickness of said orbiting wrap portion of said orbiting scroll member by increasing said wall thickness of said fixed wrap portion of said fixed scroll member at an outer peripheral surface thereof, said orbiting wrap portion overlapping said fixed wrap portion of said fixed scroll member so as to define a plurality of compression chambers, said orbiting scroll member further having a boss portion provided on a rear side of said end plate for connection with said fitting portion of said driving shaft; and an orbiting radius varying mechanism connected to said fitting portion of said driving shaft and said boss portion of said orbiting scroll member so as to vary an orbiting radius of said orbiting scroll member;

wherein said orbiting wrap portion and said fixed wrap portion are arranged such that an inner peripheral surface of said orbiting wrap portion of said orbiting scroll member and said outer peripheral surface of said fixed wrap portion of said fixed scroll member contact each other at at least a point in a circumferential direction of said orbiting wrap portion and said fixed wrap portion, and such that a clearance is formed between an outer peripheral surface of said orbiting wrap portion of said orbiting scroll member and an inner peripheral surface of said fixed wrap portion of said fixed scroll member over an entire length of said outer peripheral surface of said orbiting wrap portion and said inner peripheral surface of said fixed wrap portion.

8. A scroll fluid machine according to claim 7, wherein said orbiting radius varying mechanism comprises a crank member having a first shaft portion rotatably fitted into a hole eccentrically formed in said driving shaft, and a second shaft portion eccentric with respect to said first shaft portion and fitted to the boss portion of said orbiting scroll member.

9. A scroll fluid machine comprising:

a casing;

a fixed scroll member provided in said casing, said fixed scroll member having a spiral fixed wrap portion standing on an end plate;

a driving shaft rotatably mounted in said casing, said driving shaft having a fitting portion at a distal end thereof;

an orbiting scroll member orbitably mounted on said distal end of said driving shaft, said orbiting scroll member having a spiral orbiting wrap portion standing on a front side of an end plate, said orbiting wrap portion of said orbiting scroll member being formed with a wall thickness approximately equal to a wall thickness of said fixed wrap portion of said fixed scroll member by increasing said wall thickness of said orbiting wrap portion of said orbiting scroll member at an inner peripheral surface thereof and reducing said wall thickness at an outer peripheral surface thereof, said orbiting wrap portion overlapping said fixed wrap portion of said fixed scroll member so as to define a plurality of compression chambers, said orbiting scroll member further having a boss portion provided on a rear side of said end plate for connection with said fitting portion of said driving shaft; and an orbiting radius varying mechanism connected to said fitting portion of said driving shaft and said boss portion of said orbiting scroll member so as to vary an orbiting radius of said orbiting scroll member;

wherein said orbiting wrap portion and said fixed wrap portion are arranged such that said inner peripheral surface of said orbiting wrap portion of said orbiting scroll member and an outer peripheral surface of said fixed wrap portion of said fixed scroll member contact each other at at least a point in a circumferential direction of said orbiting wrap portion and said fixed wrap portion, and such that a clearance is formed between said outer peripheral surface of said orbiting wrap portion of said orbiting scroll member and an inner peripheral surface of said fixed wrap portion of said fixed scroll member over an entire length of said outer peripheral surface of said orbiting wrap portion and said inner peripheral surface of said fixed wrap portion.

10. A scroll fluid machine according to claim 9, wherein said orbiting radius varying mechanism comprises a crank member having a first shaft portion rotatably fitted into a hole eccentrically formed in said driving shaft, and a second shaft portion eccentric with respect to said first shaft portion and fitted to the boss portion of said orbiting scroll member.

11. A scroll fluid machine comprising:

a casing;

a fixed scroll member provided in said casing, said fixed scroll member having a spiral fixed wrap portion standing on an end plate;

a driving shaft rotatably mounted in said casing, said driving shaft having a fitting portion at a distal end thereof;

an orbiting scroll member orbitably mounted on said distal end of said driving shaft, said orbiting scroll member having a spiral orbiting wrap portion standing on a front side of an end plate, said fixed wrap portion of said fixed scroll member being formed with a wall thickness approximately equal to a wall thickness of said orbiting wrap portion of said orbiting scroll member by reducing said wall thickness of said fixed wrap portion of said fixed scroll member at an inner peripheral surface thereof and increasing said wall thickness at an outer peripheral surface thereof, said orbiting wrap portion overlapping said fixed wrap portion of said fixed scroll member so as to define a plurality of compression chambers, said orbiting scroll member further having a boss portion provided on a rear side of said end plate for connection with said fitting portion of said driving shaft; and an orbiting radius varying mechanism connected to said fitting portion of said driving shaft and said boss portion of said orbiting scroll member so as to vary an orbiting radius of said orbiting scroll member;

wherein said orbiting wrap portion and said fixed wrap portion are arranged such that an inner peripheral surface of said orbiting wrap portion of said orbiting scroll member and said outer peripheral surface of said fixed wrap portion of said fixed scroll member contact each other at at least a point in a circumferential direction of said orbiting wrap portion and said fixed wrap portion, and such that a clearance is formed between an outer peripheral surface of said orbiting wrap portion of said orbiting scroll member and said inner peripheral surface of said fixed wrap portion of said fixed scroll member over an entire length of said outer peripheral surface of said orbiting wrap portion and said inner peripheral surface of said fixed wrap portion.

12. A scroll fluid machine according to claim 11, wherein said orbiting radius varying mechanism comprises a crank member having a first shaft portion rotatably fitted into a hole eccentrically formed in said driving shaft, and a second shaft portion eccentric with respect to said first shaft portion and fitted to the boss portion of said orbiting scroll member.

* * * * *

UNITED STATES PATENT AND TRADEMARK OFFICE

CERTIFICATE OF CORRECTION

PATENT NO. : 6,224,357 B1
DATED : May 1, 2001
INVENTOR(S) : Yuji Komai et al.

It is certified that error appears in the above-identified patent and that said Letters Patent is hereby corrected as shown below:

Title page,
Item [73], the name of the Assignee is currently listed as "TOKIOCO, LTD." and should be corrected to state -- TOKICO, LTD. --

Signed and Sealed this

Eleventh Day of June, 2002

*Attest:*

*Attesting Officer*

JAMES E. ROGAN
*Director of the United States Patent and Trademark Office*